United States Patent [19]

Piller

[11] Patent Number: 4,694,181

[45] Date of Patent: Sep. 15, 1987

[54] WEB LATERAL POSITION CONTROL SYSTEM USING BOTH COARSE AND FINE MODE CONTROL MEANS

[76] Inventor: Richard G. Piller, 1500 W. 92nd, Denver, Colo. 80221

[21] Appl. No.: 882,391

[22] Filed: Jul. 7, 1986

[51] Int. Cl.[4] ..... G01N 21/86; G06K 7/015

[52] U.S. Cl. ..... 250/548; 250/557

[58] Field of Search ..... 250/548, 557, 563; 356/400, 401; 226/45, 95; 364/559; 358/107

[56] References Cited

U.S. PATENT DOCUMENTS

| | | | |
|---|---|---|---|
| 4,077,579 | 3/1978 | Seleski et al. | 250/548 |
| 4,084,099 | 4/1978 | Harvey et al. | 226/45 |
| 4,110,627 | 8/1978 | Isherwood | 250/548 |
| 4,146,797 | 3/1979 | Nakagawa | 250/548 |
| 4,485,982 | 12/1984 | St. John et al. | 250/557 |
| 4,527,069 | 7/1985 | Pfizenmaier | 250/557 |
| 4,547,800 | 10/1985 | Masaki | 356/400 |

*Primary Examiner*—David C. Nelms
*Assistant Examiner*—William L. Oen
*Attorney, Agent, or Firm*—Klaas & Law

[57] ABSTRACT

A method and apparatus for controlling the lateral position of a moving web in a dual control mode system. The control system ordinarily operates in a precise, highly-sensitive fine mode but is automatically switched into a less precise but rapidly responding coarse mode in response to loss of control in the fine mode. After control is reestablished in the coarse mode, the coarse mode control is terminated and the fine mode control is resumed.

14 Claims, 5 Drawing Figures

FINE MODE CONTROL LOGIC

COARSE MODE CONTROL LOGIC

WEB LATERAL POSITION CONTROL SYSTEM USING BOTH COARSE AND FINE MODE CONTROL MEANS

BACKGROUND OF THE INVENTION

The present invention relates generally to web control systems and, more particularly, to a dual mode control system for controlling the lateral position of a moving web.

The control of moving webs of material is important to numerous production processes. For example, in the packaging industry, material which may ultimately be formed into container cartons and the like is initially operated on in web form. Typical production operations in the packaging industry may include the printing of a repeating series of graphics on a moving web of material; the lamination of one moving web of material to another moving web of material; the creasing or cutting of predetermined portions of a moving web of material to form fold lines, etc.; and the final cutting of a moving web of material to form carton blanks or the like. In such operations, it is necessary to accurately control the lateral position of the moving webs to ensure that the printing, lamination, cutting, etc. occur at the correct position on the webs. During such production operations, web speeds may be on the order of 1000 feet per minute. At such speeds lateral misalignments for even a few minutes may result in significant and costly amounts of scrap. Thus, there is a need in such high speed operations to provide a web lateral guidance system which is capable of reacting relatively quickly to alignment errors to prevent scrap. Physical edge sensing control systems are often used in such high speed production. A commercially available edge sensing control system capable of rapid response to lateral alignment errors is manufactured by the Fife Corporation of P.0. Box 26508, Oklahoma City, Okla. 73126, and sold commercially under the name of Auto Center Control System Model PE1-11 and PE1-11L. However, a problem that exists with such rapid response edge control systems is that such systems are not suited to making extremely precise adjustments. Another precision related problem, which occurs when such edge control systems are used to control a moving web having graphics printed thereon, is caused by the fact that the relative lateral position of the graphics on a web may vary slightly from roll to roll of web material and may even vary slightly within a single roll. Thus, in situations where web lateral position is to be determined based on the position of web graphics rather than the actual physical position of the web edge, it is often preferable to use a sensor which directly senses the graphics position. An optical sensor such as Model 2201 Line Guiding System which is commercially available from the Fife Corporation of P.0. Box 26508, Oklahoma City, Okla. 73126, may be used for sensing web graphics. Such a sensor generally has a very narrow scan path on the order of 0.05 inches which is typically focused on a longitudinally extending black guide line associated with the graphics printed on a web. Such a control system is capable of providing extremely accurate control of the web so long as the associated black line falls within its scan path. However, when a gross error is encountered in the web alignment, such as may be caused by a splice in the web, such a system becomes "lost." Loss of the guide line from the scan path of such a system generally causes the production operation to terminate and requires that an operator manually realign the web with the optical scanner. A need exists for a lateral control system which is capable of precise control under normal conditions and which is capable of rapidly reestablishing control when gross errors occur.

SUMMARY OF THE INVENTION

In one specific application, the present invention is directed to solving a problem involving maintaining extremely accurate control of a web moving at high speeds based on the lateral position of printed graphics on the web while also maintaining the capability of quickly responding to gross web alignment errors. The present invention performs this function by providing a dual mode control system. In a fine mode of operation, a fine mode control system, which may include an optical scanner, monitors and responds to changes in the position of indicia relating to web lateral position such as a printed black line associated with web graphics. The fine mode scanning device is a slow responding high sensitivity device with a relatively narrow scan path, e.g. 0.05 inches, which ordinarily maintains the web within precise tolerances, e.g. 0.02 inches, of a selected position. When a misalignment occurs of sufficient magnitude to cause the lateral position indicating indicia to be removed from the area in which the fine mode sensor is operational, a coarse mode system is automatically actuated. The coarse mode system also senses a web lateral position indicating indicia which may be different from that of the fine mode lateral position indicating indicia. For example, the coarse mode sensor may be a pneumatic sensor which senses the physical edge of the moving web. The coarse mode sensor is adapted to have a relatively broad scan path, e.g. ½ inch, in which to monitor the web edge and detect lateral misalignment. The coarse mode system is adapted to respond relatively quickly to an alignment error. Thus, when a web is misaligned to a degree which makes the fine mode control system inoperable, the coarse mode control system is actuated and quickly brings the web back into sufficiently close lateral alignment, e.g. 0.05 inches, with a predetermined alignment position so as to enable the fine mode sensor to once again sense the lateral position indicating indicia associated therewith, at which point the coarse mode system is deactuated and the fine mode system resumes control.

The apparatus by which the fine mode and coarse mode systems adjust the lateral alignment of the web may include conventional alignment system components such as electronic pneumatic or hydraulic signal means and electric, pneumatic or hydraulic motors or cylinders associated with selected web rolls and having the capability of moving the selected web rolls laterally by an amount scaled to a control signal received from an associated lateral position indicating sensor. It is contemplated that a single position adjusting assembly may be used and actuated alternately by the fine mode sensor and the coarse mode sensor. It is also contemplated, in the alternative, that the fine mode sensor and the coarse mode sensor may each be provided with a separate lateral position adjusting assembly.

Thus, the present invention may comprise: a control system for controlling the lateral position of a moving web of material comprising: (a) a first sensor means having a first relatively wide transversely extending scan path for sensing the relative lateral position of web lateral position indicating indicia associated with the moving web and generating a first sensor signal indicative of the relative lateral position of the web; (b) coarse mode control means for causing relatively rapid adjustment of the lateral position of the web in response to said first sensor signal for returning the web to a predetermined lateral position within a first set of tolerances during a coarse mode of control; (c) a second sensor means having a second relatively narrow transversely extending scan path for sensing the relative lateral position of web lateral position indicating indicia associated with the moving web and generating a second sensor signal indicative of the relative lateral position of the web; (d) fine mode control means for causing adjustment of the lateral position of the web in response to said second sensor signal for maintaining the web in said predetermined lateral position within a second set of tolerances different from said first set of tolerances in a fine mode of control; (e) control mode switching means for switching from said fine control mode to said coarse control mode whenever said web position indicating indicia sensed by said second sensor are not detected thereby for a predetermined period of time and for switching from said coarse control mode to said fine control mode whenever said second sensor continuously detects the presence of said web position indicating indicia for a predetermined period of time.

The invention may also comprise: a control system for controlling the relative lateral position of a moving web of material having a repeating series of graphics printed thereon based upon the lateral position of the graphics with respect to a fixed station along the web comprising: (a) optical sensor means for sensing the relative lateral position of a longitudinally extending guide line printed on the web in fixed spacial relationship with the repeating series of graphics, and generating an optical sensor control signal indicative of the relative lateral position of said guide line within a relatively narrow transversely extending guide line detection zone of said optical sensor said signal being also indicative of the presence and absence of said guide line from said scan path; (b) web edge sensor means for sensing the relative lateral position of an edge portion of said moving web and generating an edge sensor control signal indicative of the relative lateral position of said web edge portion within a relatively broad transversely extending edge detection zone of said web edge sensor means; (c) web lateral position adjustment means for adjusting the relative lateral position of the moving web in response to a control signal from said optical sensor means in a fine control mode and said edge sensor means in a coarse control mode; (d) mode control means for receiving said optical sensor signal and for enabling operation of said control system in a fine control mode when said optical sensor signal indicates the presence of said guide line in said optical sensor detection zone and for enabling operation of said control system in a coarse operating mode when said sensor signal indicates the absence of said guide from said optical sensor detection zone.

The invention may also comprise: a method of controlling the lateral position of a moving web of material having at least one substantially linear lateral side edge and having graphics printed thereon including a guide line oriented in generally parallel relationship to the lateral side edge at a preset distance therefrom, comprising the steps of: (a) monitoring the relative lateral position of the lateral edge of the web with an edge sensor having a relatively broad detection zone and generating a web edge monitoring signal in response to the detected position of the lateral edge of the web; (b) monitoring the relative lateral position of the guide line with a line sensor having a relatively narrow detection zone and generating a guide line monitoring signal in response to the detected position of the guide line and the absence of the guide line from the detection zone; (c) controlling the lateral position of the web in a fine operating mode based on the guide line monitoring signal; (d) selecting one of the coarse operating mode and the fine operating mode based upon the guide line monitoring signal by selecting the coarse operating mode when the guide line is detected to be absent from the detection zone of the line sensor and by selecting the fine operating mode when the guide line is detected to be present in the detection zone of the line sensor.

The invention may also comprise: a method of controlling the lateral position of a moving web of material comprising the steps of: (a) monitoring a lateral position indicating indicia of the web with a first sensor having a relatively small width first detection zone and generating a first detection signal in response thereto; (b) controlling the lateral position of the web in response to the first detection signal so long as the lateral position monitored by the first sensor indicating indicia remains in the first detection zone; (c) monitoring a lateral position indicating indicia of the web with a second sensor having a relatively large width second detection zone and generating a second detection signal in response thereto; (d) controlling the lateral position of the web in response to the second detection signal so long as the lateral position indicating indicia monitored by the first sensor is not detected thereby.

DETAILED DESCRIPTION OF THE INVENTION

Figure 1:
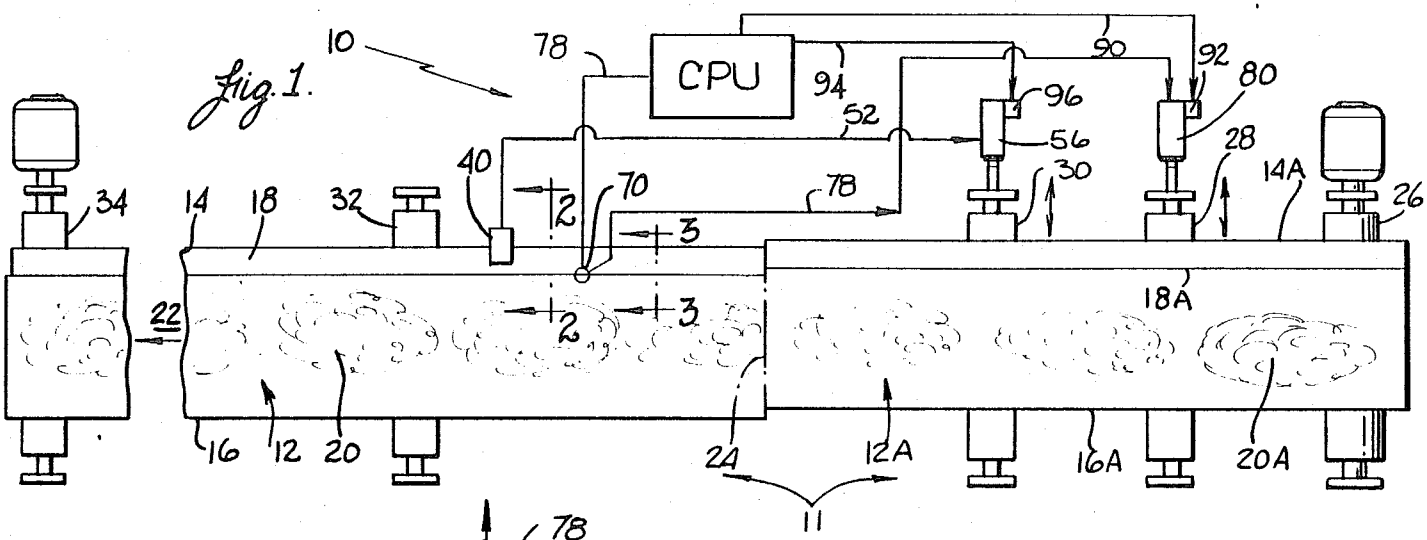
FIG. 1 is a schematic plan view of a web dual mode lateral control system of the present invention.

A web dual mode lateral control system 10 is shown schematically in FIG. 1. A moving web of material 11 comprises a first web portion 12 having a first lateral edge 14 and second lateral edge 16. Web portion 12 is provided with a printed black guide line 18 which extends longitudinally of the web. The line 18 is positioned at a fixed location with respect to graphics 20 printed on the web portion 12. The web 11 moves in the direction indicated at 22. The first web portion 12 is spliced at 24 to a second web portion 12A having a first edge and second edge 14A, 16A, a guide line 18A, and associated graphics 20A which correspond identically to those of web 12 except for a slight lateral misalignment between the first web portion 12 and the second web portion 12A, which misalignment may be on the order of ¼ inch. The web 11 may be supplied from a conventional unwind roll 26 and may pass over a series of idler rolls 28, 30, 32, etc. and, after having various operations (not shown) performed thereon, may be collected by a conventional takeup roll 34.

Figure 2:
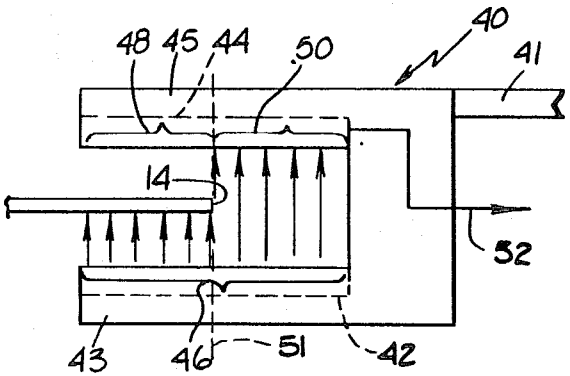
FIG. 2 is a schematic cross-sectional elevation view of a coarse mode sensor.

As illustrated by FIGS. 1 and 2, a coarse mode sensor means, which may comprise a pneumatic edge sensor 40, may be mounted as by a support member 41, in operable association with web lateral edge portion 14. The pneumatic sensor may be similar or identical in construction and operation to that sold by the Fife Corporation of Oklahoma City, Okla. as a component of its Auto Center Control System Model PE1-11 and PE1-11A. Such a sensor, as indicated in FIG. 2, may comprise an air plenum 42 in a lower arm portion 43 thereof which transmits a column of air 46 to an air receiver 44 provided in an upper arm portion 45 directly above lower arm portion 43. The sensor 40 is positioned at a fixed location with respect to the moving web 12. Relative lateral movement of the web causes a corresponding variance in the air flow from the air plenum 42 to the air receiver portion 44 of the sensor. Variations in the length of a blocked portion 48 of air column 46 and a received portion 50 of air column 46 produce corresponding changes in a pneumatic control signal 52 generated by the sensor 40. Thus signal 52 is directly indicative of the relative lateral position of the moving web edge 14. This signal 52 is transmitted to a conventional hydraulic shifting assembly 56 which responds to variations in the control signal to shift idler roll 30 in an appropriate lateral direction to bring the edge 14 back into a preset alignment position, e.g. position 51, with the edge sensor 40. The coarse mode control system 40, 54, 56, etc. may comprise a system similar or identical to the Auto Center Control System manufactured by the Fife Corporation as referenced above.

Figure 3:
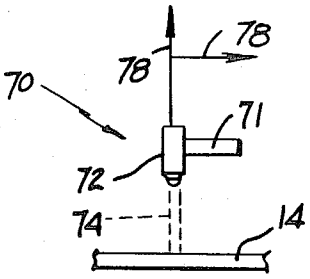
FIG. 3 is a schematic elevation view of a fine mode sensor.

As illustrated in FIGS. 1 and 3, a fine mode sensor means may comprise a conventional optical scanner such as a photoelectric scanner used in the Fife Corporation Model 2201 Line Guiding System referenced above. The fine mode sensor means 70 may be mounted on support member 71 and may comprise a photoelectric sensor 72 having a single, relatively small width, e.g. 0.05 inch, scan path. The sensor 72 generates and transmits a control signal 78 to a conventional hydraulic shifting assembly 80 which may be more finely tuned and slower responding than the hydraulic control system 56 associated with the coarse mode sensor. In operation, the photoelectric sensor 72 generates a control signal 78 which is indicative of the position of line 18 within its scan path 74 and which is also indicative of the presence or absence of line 18 in the scan path. This signal 78 is sent to a central processing unit (CPU) 100 which uses the signal to select coarse mode or fine mode operation as described below. The signal 78 is also sent to hydraulic shifting assembly 80, which may be identical to the shifting assembly of the Fife Corporation Model 2201 Line Guiding System. The hydraulic shifting system 80 is thereby actuated to shift idler spool 28 laterally to maintain line 18 at a relatively fixed location in the scan path 74. From the fine mode control signal 78 the CPU determines whether or not the guide line 18 is within the scan path 74 of the photoelectric sensor 72. If, during fine mode operation, signal 78 indicates the continuous absence of line 18 from scan path 74 for a predetermined duration, e.g. ½ second, then the CPU sends a signal 90 to deactuate the fine mode operating system and simultaneously sends a signal 94 to actuate the coarse mode operating system. After the coarse mode system has been actuated and moves the web laterally into sufficiently close alignment with predetermined position 51 such that the line 18 is once again sensed by the fine mode sensing system and control signal 78 to the CPU so indicates for a predetermined duration, e.g. 20 milliseconds, then the CPU sends signals 90, 94 to reactuate the fine mode control system and deactuates the coarse mode control system. As illustrated in FIG. 1, the CPU signal 90 is preferably an on/off signal to an on/off control box portion 92 of the fine mode hydraulic shifting assembly and signal 94 is preferably an on/off signal to an on/off control box portion 96 of the coarse mode hydraulic shifting assembly. Thus, both the coarse mode sensor means 40 and the fine mode sensor means 70 may be operational continuously, but the determination as to which shifting assembly 56, 80 is used to control the web is based upon whether or not guide line 18 falls within the scan path 74 of the fine mode sensor means 70. Although the above-described embodiment of the invention describes a CPU such as a microcomputer for generating mode switching signals, it will also be understood by those having skill in the art that conventional "hard wired" circuitry may also be provided to perform this function.

The control circuitry for the coarse mode sensor is preferably constructed and arranged to provide a critically damped analog response, i.e. the control circuitry is tuned to slightly underrespond to a sensed alignment error to prevent cycling of the system. The control circuitry of the coarse mode is adapted to respond relatively quickly, e.g. within a period of 0.1 seconds to an alignment error of up to ½ inch in magnitude. The control circuitry of the fine mode control system is also critically damped, but is de-tuned and adapted to response much more slowly and more precisely than the coarse mode sensor. It will be appreciated from the above disclosure that the dual mode control system of the present invention enables a fine mode control under normal conditions based upon the position of the printed graphics on the web rather than on the physical position of the web, and also enables a coarse mode control based on the physical position of the web under abnormal conditions in which a large magnitude misalignment causes the fine mode control system to become lost. The coarse mode control, although not as precise as the fine mode control, is sufficiently accurate to adjust the web to a position at which the fine mode control system may once again resume control. Thus, ordinarily, precise web lateral position control based on web graphics position is provided, and, when large scale misalignments do occur, the control system switches modes such that the lateral position of the web is quickly adjusted. Thereafter the system again switches modes such that precise control resumes without need for operator intervention.

Figure 4:
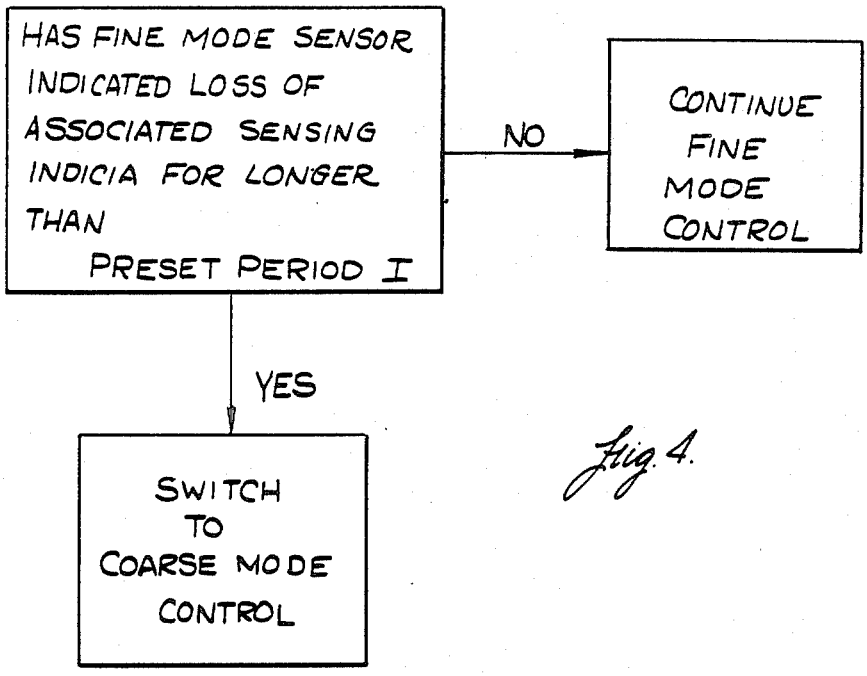
FIG. 4 is a block diagram illustrating fine mode control logic.
Figure 5:
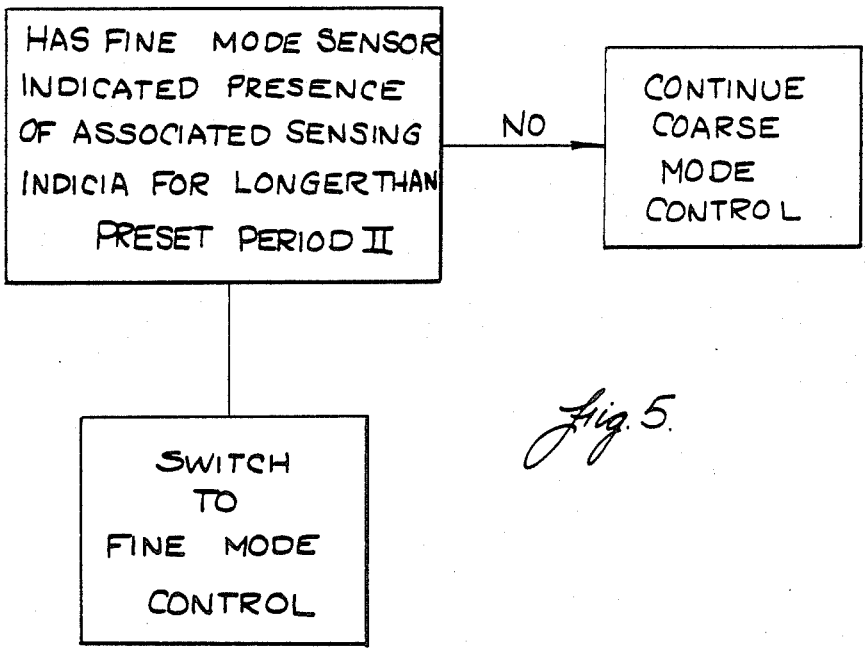
FIG. 5 is a block diagram illustrating coarse mode control logic.

The basic system control logic is illustrated in FIGS. 4 and 5.

It is contemplated that the inventive concepts herein described may be variously otherwise embodied and it is intended that the appended claims be construed to include alternative embodiments of the invention except insofar as limited by the prior art.

What is claimed is:

1. A control system for controlling the lateral position of a moving web of material comprising:

(a) a first sensor means having a first relatively wide scan path extending transversely of the web for sensing the relative lateral position of preselected web lateral position indicating indicia associated with the first sensor means and generating a first sensor signal indicative of the relative lateral position of the web;

(b) coarse mode control means for causing relatively rapid adjustment of the lateral position of the web in response to said first sensor signal for adjustably moving the web to a predetermined lateral position within a first set of tolerances during a coarse mode of control;

(c) a second sensor means having a second relatively narrow transversely extending scan path for sensing the relative lateral position of preselected web lateral position indicating indicia associated with the second sensor means and generating a second sensor signal indicative of the relative lateral position of the web;

(d) fine mode control means for causing adjustment of the lateral position of the web in response to said second sensor signal for maintaining the web in said predetermined lateral position within a second set of tolerances in a fine mode of control;

(e) control mode switching means for switching from said fine control mode to said coarse control mode whenever said web position indicating indicia associated with said second sensor are not detected thereby for a predetermined period of time and for switching from said coarse control mode to said fine control mode whenever said second sensor continuously detects the presence of said web position indicating indicia associated therewith for a predetermined period of time.

2. The invention of claim 1 wherein said first sensor means and said second sensor means are adapted for sensing different web position indicating indicia.

3. The invention of claim 2 wherein said first sensor means is adapted for sensing a physical edge of the web and wherein said second sensor means is adapted for sensing printed indicia on said web.

4. The invention of claim 3 wherein said first sensor comprises a pneumatic sensor and wherein said second sensor means comprises a photoelectric sensor.

5. The invention of claim 1 wherein said first sensor actuates a first web lateral position adjustment means and wherein said second sensor actuates a second web lateral position adjustment means wherein said first position adjustment means is faster responding and less precise than said second adjustment means.

6. A control system for controlling the relative lateral position of a moving web of material having a repeating series of graphics printed thereon based upon the lateral position of the graphics with respect to a fixed station along the web comprising:

(a) optical sensor means for sensing the relative lateral position of a longitudinally extending guide line printed on the web in fixed spacial relationship with the repeating series of graphics, and generating an optical sensor control signal indicative of the relative lateral position of said guide line within relatively narrow transversely extending guide line detection zone of said optical sensor means, said optical sensor control signal being also indicative of the presence and absence of said guide line from said detection zone;

(b) web edge sensor means for sensing the relative lateral position of an edge portion of said moving web and generating an edge sensor control signal indicative of the relative lateral position of said web edge portion within a relatively broad transversely extending edge detection zone of said web edge sensor means;

(c) web lateral position adjustment means for adjusting the relative lateral position of the moving web in response to a control signal from said optical sensor means in a fine control mode and from said edge sensor means in a coarse control mode;

(d) mode selection means for receiving said optical sensor signal and for enabling operation of said control system in said fine control mode during periods when said optical sensor signal indicates the presence of said guide line in said optical sensor detection zone and for enabling operation of said control system in the coarse control mode during periods when said sensor signal indicates the absence of said guide from said optical sensor detection zone.

7. The invention of claim 6 wherein said web lateral position adjustment means comprises a fine mode adjustment means operably associated with said optical sensor means and a coarse mode adjustment means operably associated with said edge sensor means.

8. The invention of claim 7 wherein said coarse mode adjustment means operates relatively more quickly than said fine mode adjustment means and wherein said fine mode adjustment means operates relatively more precisely than said coarse mode adjustment means.

9. The invention of claim 8 wherein said mode control means comprises electronic processing means for receiving said signal from said optical sensor means and for generating a switching signal to actuate said fine mode web adjustment means and to deactuate said coarse mode adjustment means to initiate fine mode control and for generating a switching signal to actuate said coarse mode adjustment means and to deactuate said fine mode adjustment means to initiate coarse mode control.

10. A method of controlling the lateral position of a moving web of material having at least one substantially linear lateral side edge and having graphics printed thereon including a guide line oriented in generally parallel relationship to the linear lateral side edge of the web at a preset distance therefrom, comprising the steps of:

(a) monitoring the relative lateral position of the lateral edge of the web with an edge sensor having a relatively broad detection zone and generating a web edge monitoring signal in response to the detected position of the lateral edge of the web;

(b) monitoring the relative lateral position of the guide line with a line sensor having a relatively narrow detection zone and generating a guide line monitoring signal in response to the detected position of the guide line and also to the detected presence and absence of the guide line from the detection zone;

(c) controlling the lateral position of the web in a coarse operating mode based on the web edge monitoring signal;

(d) controlling the lateral position of the web in a fine operating mode based on the guide line monitoring signal;

(e) selecting one of the coarse operating mode and the fine operating mode based upon the guide line monitoring signal by selecting the coarse operating mode when the guide line is detected to be absent from the detection zone of the line sensor and by selecting the fine operating mode when the guide line is detected to be present in the detection zone of the line sensor.

11. The method of claim 10:

wherein the step of controlling the lateral position of the web in a coarse operating mode comprises adjusting the lateral position of the web rapidly with relatively coarse accuracy; and wherein the step of controlling the lateral position of the web in a fine operating mode comprises adjusting the lateral position of the web relatively slowly with relatively precise accuracy.

12. The invention of claim 11:

wherein the step of controlling the lateral position of the web in the coarse mode comprises actuating a coarse mode lateral control assembly; and wherein the step of controlling the lateral position of the web in the fine mode comprises actuating a fine mode lateral control assembly which is separate from the coarse mode lateral control assembly.

13. The invention of claim 10 wherein the step of selecting one of the coarse mode and the fine mode comprises processing the line sensor signal with electronic processing means.

14. A method of controlling the lateral position of a moving web of material comprising the steps of:

(a) monitoring a lateral position indicating indicia of the web with a first sensor having a relatively small width first detection zone and generating a first detection signal in response thereto;

(b) controlling the lateral position of the web in response to the first detection signal so long as the lateral position indicating indicia monitored by the first sensor is detected in the first detection zone;

(c) monitoring a lateral position indicating indicia of the web with a second sensor having a relatively large width second detection zone and generating a second detection signal in response thereto;

(d) controlling the lateral position of the web in response to the second detection signal so long as the lateral position indicating indicia monitored by the first sensor is detected to be absent from the first detection zone.

* * * * *